US006296436B1

(12) United States Patent
Ramun

(10) Patent No.: US 6,296,436 B1
(45) **Date of Patent: *Oct. 2, 2001**

(54) MULTIPURPOSE COUNTERWEIGHT HOUSING AND COUNTERWEIGHT

(75) Inventor: John R. Ramun, Poland Township, OH (US)

(73) Assignee: Allied Gator, Inc., Youngstown, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 343 days.

(21) Appl. No.: 08/826,832

(22) Filed: Apr. 8, 1997

(51) Int. Cl.[7] ..... E02F 9/18

(52) U.S. Cl. ..... 414/719; 212/195; 280/760

(58) Field of Search ..... 414/719, 690, 414/694, 687; 212/178, 195; 296/190; 180/89.12; 280/755, 757, 758, 759, 760

(56) References Cited

U.S. PATENT DOCUMENTS

| | | | | |
|---|---|---|---|---|
| 2,925,149 | * | 2/1960 | Hughson | 280/759 X |
| 3,614,135 | * | 10/1971 | Eid | 280/759 X |
| 3,860,083 | * | 1/1975 | Yancey | 296/190 X |
| 4,650,393 | * | 3/1987 | Denda | 414/694 X |
| 4,679,336 | * | 7/1987 | BrOcklebank et al. | 414/719 X |
| 5,033,567 | * | 7/1991 | Washburn et al. | 180/89.12 |

* cited by examiner

*Primary Examiner*—Donald W. Underwood
(74) *Attorney, Agent, or Firm*—Webb Ziesenheim Logsdon Orkin & Hanson, P.C.

(57) ABSTRACT

Construction equipment such as an excavator is provided with a counterbalance assembly positioned at the aft end of the construction equipment. The counterbalance assembly includes a pair of enclosures and a counterweight. The pair of enclosures is separated by a back panel and a bottom panel connected to opposed side walls of the enclosures. The back panel, the bottom panel and the opposed side walls form an aperture for receiving the counterweight. The pair of enclosures and the counterweight are separable from each other and from the construction equipment to enable transportation of the construction equipment apart from the pair of enclosures and the counterweight.

20 Claims, 4 Drawing Sheets

MULTIPURPOSE COUNTERWEIGHT HOUSING AND COUNTERWEIGHT

BACKGROUND OF THE INVENTION

1. Field of the Invention

This invention relates to construction equipment and, more specifically, to counterweights utilized to counterbalance construction equipment, such as excavators and cranes.

2. Description of the Prior Art

Excavators and cranes are common types of construction equipment. Excavators are typically utilized to dig earth thereby forming troughs or cavities in the ground. Cranes are utilized to lift heavy objects, such as steel beams, overhead. Thess types of construction equipment generally includes a base having an upper section mounted thereabove. The base includes treads or wheels for enabling movement of the construction equipment. The upper section is attached to the base for rotation about a vertical axis extending through the base and the upper section. The upper section of the construction equipment typically includes an operator cab and an arm or boom positioned on the fore end of the construction equipment. The aft end of the upper section includes a counterweight to offset the weight of the arm and the weight of any material lifted by the arm. An engine is positioned in front of the counterweight to provide power to the treads or wheels and to the hydraulic system and/or electrical system utilized to operate the arm and other systems of the equipment.

The counterweight is often formed of steel cavity filled with concrete or metal packing. The counterweight is generally attached to the construction equipment, and its only purpose is to offset the weight of the arm and any weight lifted by the arm during excavation or lifting activities. The weight of such counterweight is selected in part on the size and designed lifting capacity of the construction equipment.

A problem with such counterweights is that the space occupied by the counterweight is unusable for other purposes.

It is therefore an object of the present invention to provide a multipurpose removable counterweight housing and removable counterweight to replace the concrete or metal packing filled counterweight of the prior art. It is another object of the invention to provide usable space heretofore occupied by the counterweight of the prior art.

SUMMARY OF THE INVENTION

Accordingly, I have invented a counterbalance assembly for use on an aft end of construction equipment having a lifting element, such as a pivotable arm, for lifting material and/or a construction tool, such as a wrecking ball, shears, a bucket, grapples and the like, positioned adjacent the fore end. The counterbalance assembly of my invention includes at least one enclosure attached to the aft end of the construction equipment and a counterweight attached to the aft end of the construction equipment adjacent the enclosure.

In one embodiment of my invention, the counterbalance assembly includes two enclosures, a back panel, a bottom panel and a counterweight. Each enclosure has at least a back wall connected to a side wall. The enclosures are positioned so that the side walls are in opposition. The back panel is connected between the back walls of the enclosures and the bottom panel is connected adjacent a lower edge of the back panel and between a lower portion of the side walls of the enclosures. The counterweight is receivable in a receiving aperture defined by the opposed side walls of the enclosures, the back panel and the bottom panel.

Each enclosure may include a cover that abuts the back wall and the side wall. The side wall of each enclosure may further include a lug that extends upwardly from the intersection of the side wall and the cover. The lugs have holes therethrough for accepting chains, hooks and the like of a lift that is utilized to hoist the enclosure onto the aft end of construction equipment. The enclosures may further have access doors positioned adjacent a front panel connected between the side walls and in opposition to the back panel thereby further defining the receiving aperture. The access doors may be pivotally hinged along a vertical access adjacent the side walls and the front panel. The back walls of the enclosure may further include a vent for enabling air to flow through the enclosures.

The counterweight may also include at least one upwardly extending lug positioned adjacent the upwardly extending lug of the enclosures when the counterweight is received in the receiving aperture. The lug of the counterweight has a hole therethrough that is utilized to hoist the counterweight into position in the receiving aperture.

I have also invented construction equipment, such as an excavator or a crane, having a base and an upper section rotatably mounted on the base and rotatable about a rotation axis extending through the base and the upper section. An arm is pivotally attached to a fore end of the upper section and a counterbalance assembly attached adjacent the aft end of the upper section. An engine compartment is positioned on the upper section adjacent the counterbalance assembly.

The counterbalance assembly includes a bottom panel attached to the upper section, a back panel attached to the bottom panel adjacent the engine compartment, at least one enclosure having a side wall attached to the bottom panel and the back panel, and a counterweight positioned in a receiving aperture formed by the back panel, the bottom panel and the side wall of the enclosure.

The bottom panel may further include an upwardly extending boss for complementary engagement with a cavity formed on an underside of the counterweight. The boss and the cavity cooperate to prevent lateral shifting of the counterweight in the receiving aperture. The enclosure may include an access door positionable adjacent an edge of the side wall opposite the back panel.

The access door, the enclosure and a cover of the engine compartment may each have air vents. The air vent of the cover of the engine compartment and the air vent of the enclosure are positioned so that air entering the air vent of the access door flows through the enclosure and into the air vent of the engine compartment.

These and other advantages of the present invention will be clarified in the detailed description of the preferred embodiments taken together with the attached figures wherein like reference numerals represent like elements throughout.

DETAILED DESCRIPTION OF THE PREFERRED EMBODIMENTS

Figure 1:
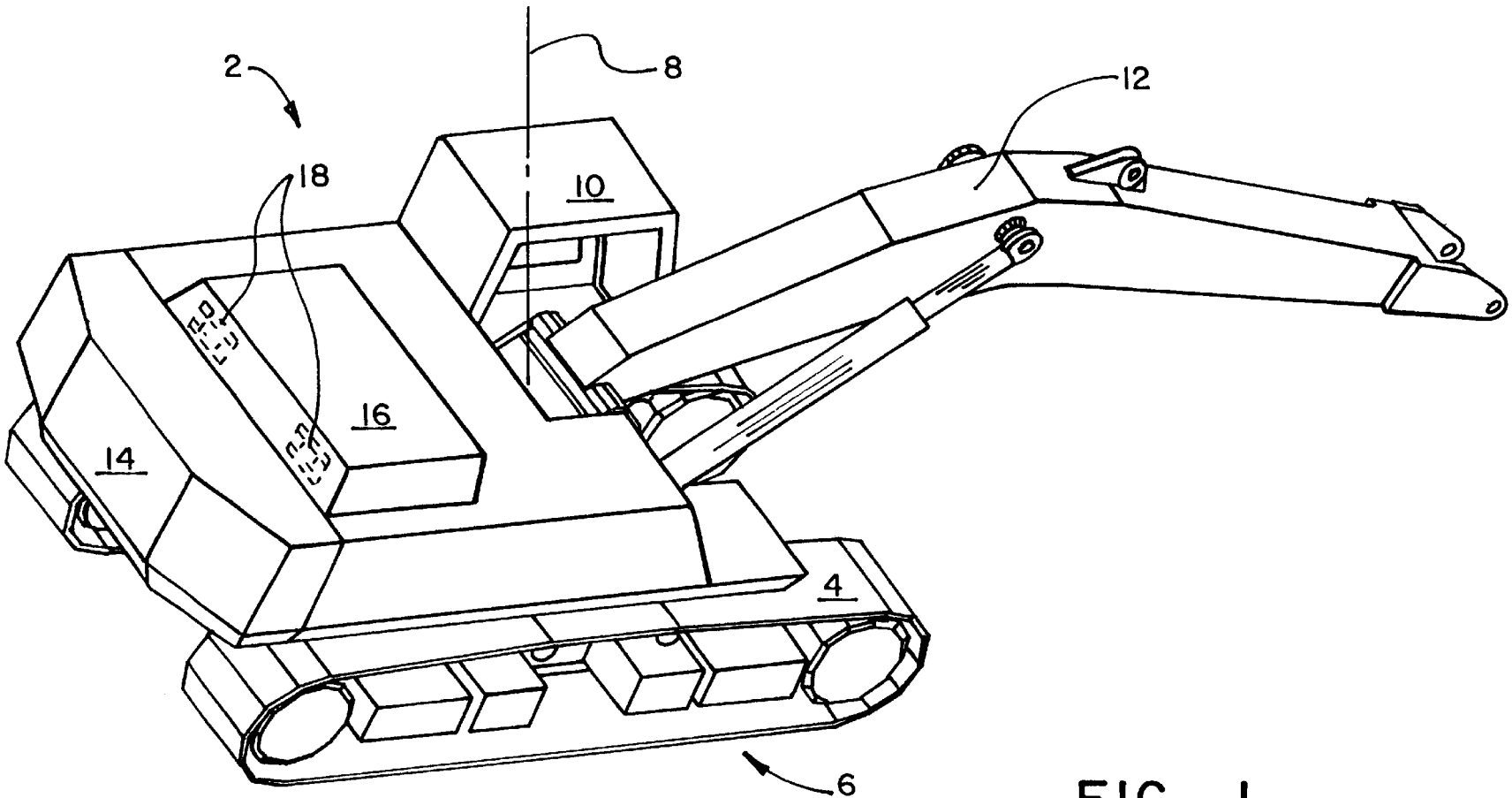
FIG. 1 (PRIOR ART)
FIG. 1 is a perspective view of an excavator including a prior art counterweight.

With reference to FIG. 1, an excavator 2 includes an upper section 4 and a base 6. The upper section 4 is rotatably attached to the base 6 for rotation about a rotation axis 8 extending through the upper section 4 and the base 6. The upper section 4 can be rotated independent of the base 6, as is known in the art. The upper section 4 includes an operator cab 10 and a work arm or boom 12 pivotally positioned at the fore end of the upper section 4 and a counterweight 14 positioned at the aft end of the upper section 4. An excavating tool (not shown) such as a bucket or the like is removably attached to the boom 12 in a conventional fashion. An engine cover 16, positioned forward of the counterweight, covers an engine compartment that houses, among other things, an engine and a radiator system of the excavator 2. The engine cover 16 can include one or more engine cover vents 18 (shown in phantom) which provide a path for air between the engine compartment and an atmosphere outside the engine compartment.

Prior art counterweights, like the counterweight 14 shown in FIG. 1, are typically formed of a metal packing or concrete filled steel or cast iron enclosure. The weight of the counterweight will vary depending on the size and designed lifting capacity of the excavator 2.

Figure 2:
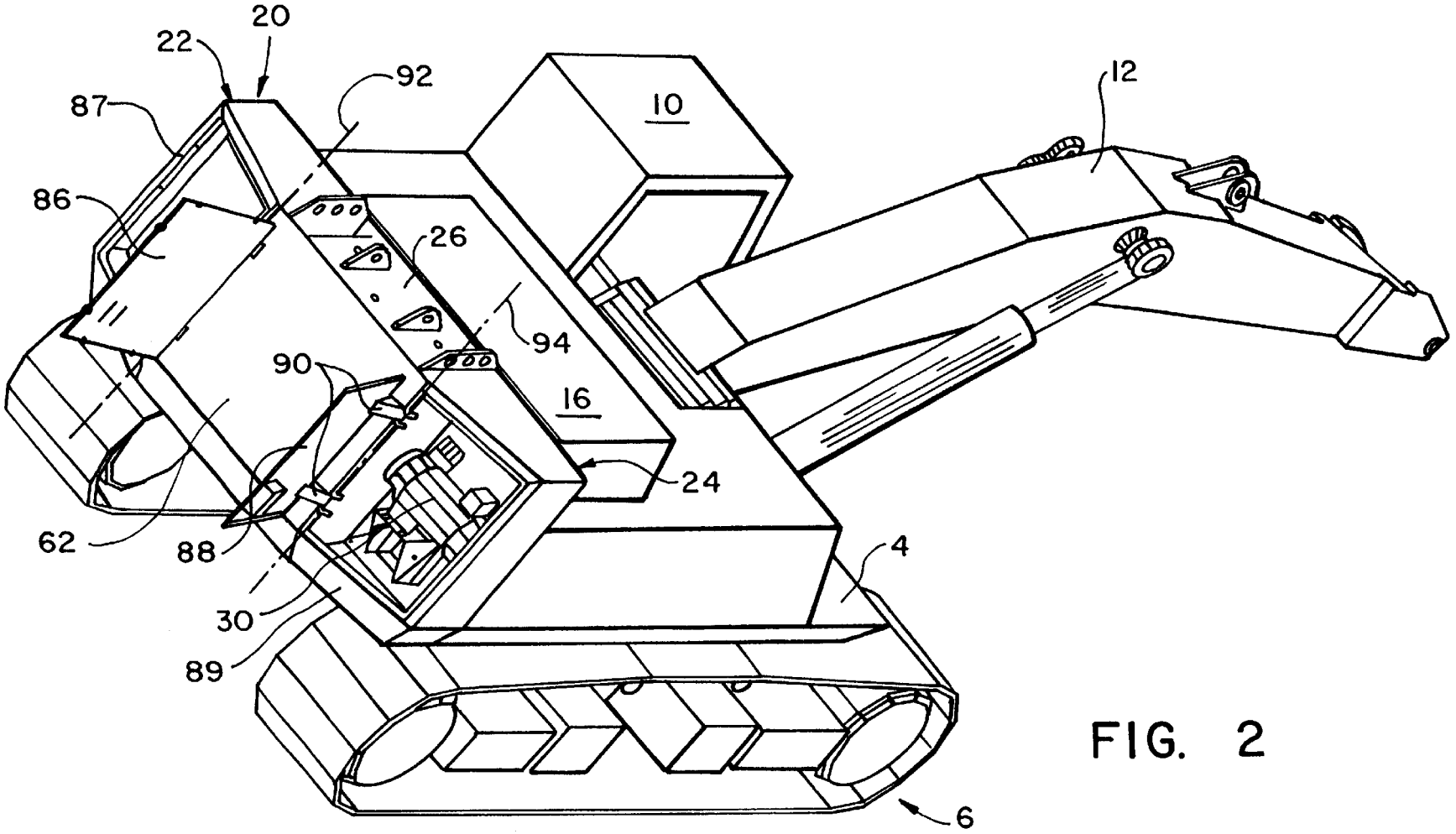
FIG. 2 is a perspective view of an excavator including a counterweight housing and counterweight attached to the aft end thereof in accordance with the present invention.

With reference to FIG. 2, in accordance with the present invention, the prior art counterweight 14 is replaced with a counterbalance assembly 20. The counterbalance assembly 20 includes a first box-shaped enclosure 22 positioned on the operator cab side of the upper section 4, a second box-shaped enclosure 24 positioned opposite the operator cab side of the upper section 4 and a block-shaped counterweight 26 positioned between the first enclosure 22 and the second enclosure 24. The first and second enclosures 22, 24 are general-purpose enclosures that can be utilized to house, without limitation, hydraulic systems and/or other electrical devices that are driven from the engine and/or hydraulic systems of the excavator 2. In the embodiment shown in FIG. 2, the second enclosure 24 has an auxiliary generator 30 therein for providing electrical power to devices onboard and/or offboard the excavator 2. The enclosures 22, 24 could also be utilized as storage boxes for storing other excavation site related equipment, such as shovels, axes, picks and the like, not requiring electrical or fluid power connection to the excavator 2. In FIG. 2, the counterbalance assembly 20 is shown attached to an excavator 2, however, the counterbalance assembly 20 may be adapted for use with other construction equipment which utilizes counterweights.

Figure 3:
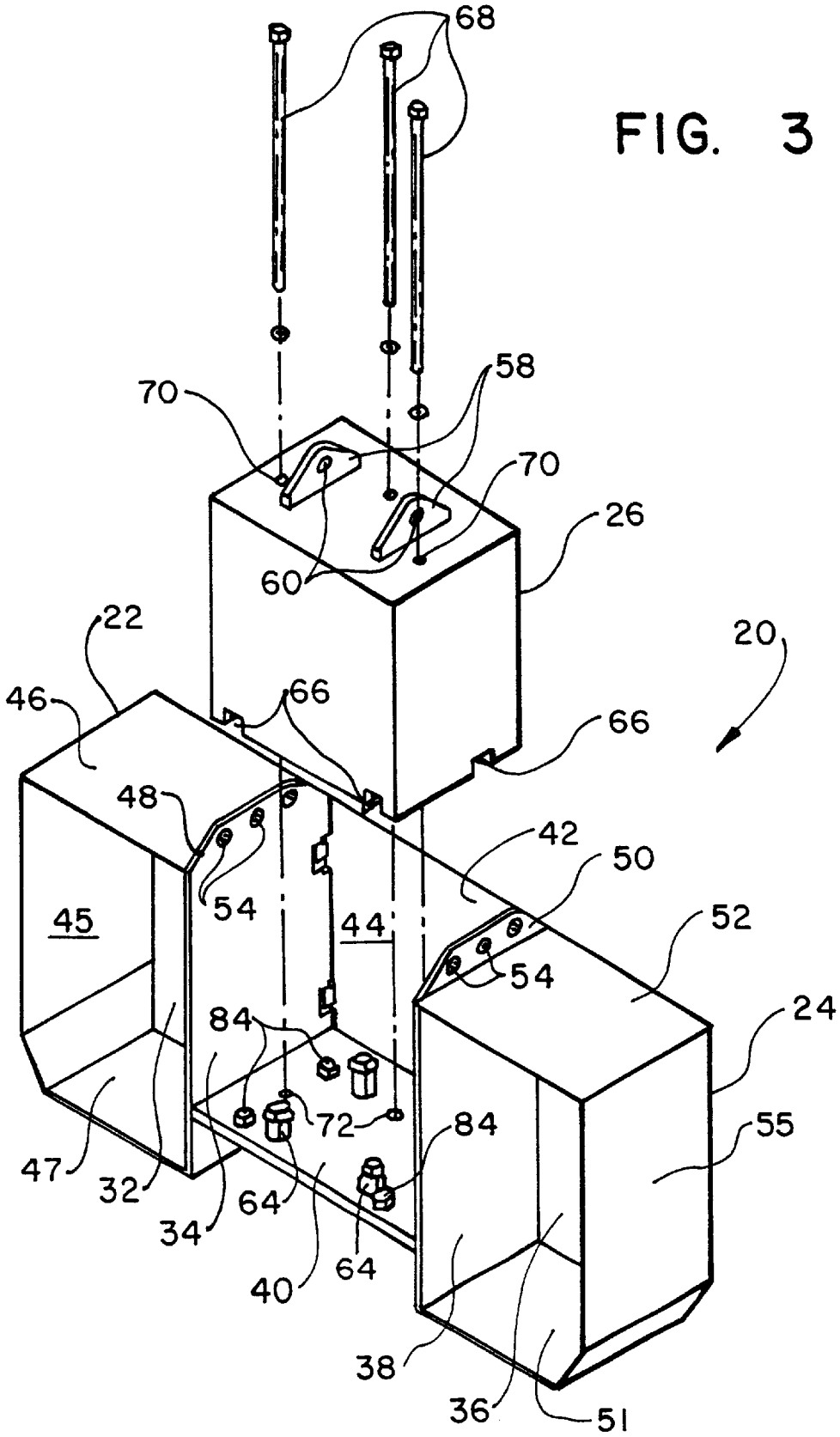
FIG. 3 is an exploded, perspective view of the counterweight housing and counterweight of FIG. 2 with the front panel and the access doors removed.
Figure 4:
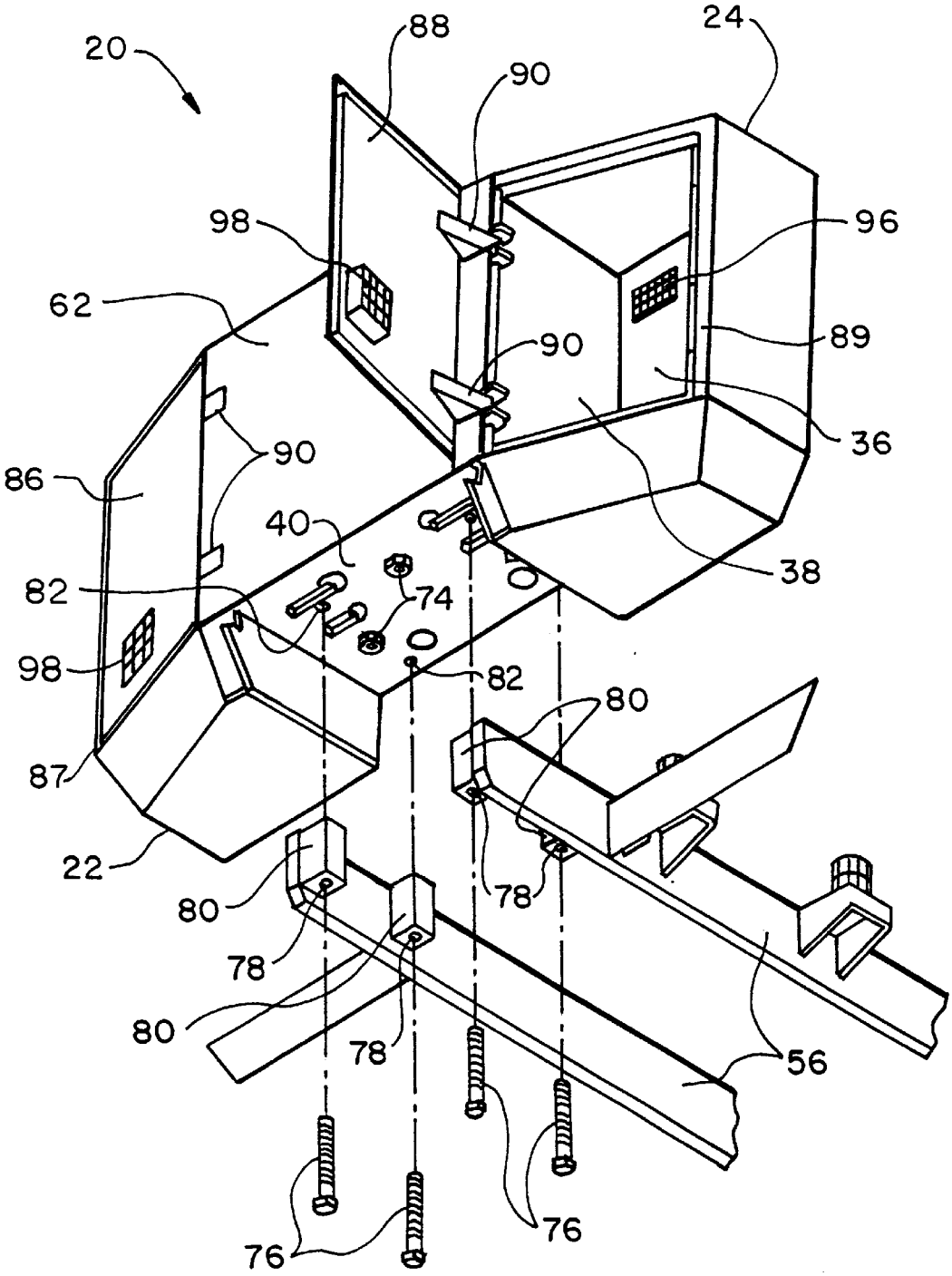
FIG. 4 is an exploded, perspective view of the counterweight housing and counterweight attached to the frame of the excavator of FIG. 2.

With reference to FIGS. 3 and 4, the first enclosure 22 includes a back wall 32 and a side wall 34 and the second enclosure 24 includes a back wall 36 and a side wall 38. Access to the engine or the like may be provided through the back walls 32 and 36 as required. The enclosures 22, 24 are positioned so that side wall 34 is in opposition to side wall 38. A base or bottom panel 40 extends between a lower portion or extent of side walls 34 and 38 and is connected thereto in a suitable manner such as welding. Similarly, a back panel 42 extends between the back walls 32 and 36 and is connected thereto and to bottom panel 40 in a suitable manner such as welding. The back walls 32, 36 and the back panel 42 are preferably coplanar such that these elements may be formed from a single, continuous sheet of metal. The side walls 34, 38, bottom panel 40 and back panel 42 form a receiving aperture 44 of a sufficient extent to receive counterweight 26 therein.

The first enclosure 22 has a cover 46 that abuts a top edge of back wall 32 and an upper portion of side wall 34. An outer side wall 45 extends down from an outer edge of the cover 46 to a bottom 47. The outer side wall 45 has a lower portion thereof which tapers inwardly essentially to match the configuration of the upper section 4 of the excavator 2 as shown in FIG. 2. The bottom 47 is spaced from and generally parallel to the cover 46 and abuts against the lowermost edges of the side wall 34, the back wall 32 and the outer side wall 45. Consequently, the bottom 47 is positioned below the bottom panel 40.

The side wall 34 has a lug 48 that extends above the intersection of the side wall 34 and the cover 46. Similarly, side wall 38 has a lug 50 that extends above the intersection of side wall 38 and a cover 52 of the second enclosure 24. Analogous to cover 46, cover 52 abuts a top edge of back wall 36 and an upper portion of side wall 38. Additionally, the second enclosure 24 includes a side wall 55 and a bottom 57 substantially the same as side wall 45 and bottom 47 of the first enclosure 22. The lugs 48, 50 have holes 54 therethrough for accepting chains, hooks and the like of a lift (not shown) that is utilized to hoist the enclosure assembly, including first enclosure 22, second enclosure 24, bottom panel 40 and back panel 42, onto and off of a frame 56 of the upper section 4 of the excavator 2. Moreover, the counterweight 26 has one or more lugs 58 positioned on a top side thereof. The lugs 58 have holes 60 therethrough that are utilized to hoist the counterweight 26 into and out of position in the receiving aperture 44 when the enclosure assembly (i.e., enclosures 22 and 24 and receiving aperture 44) is positioned on the frame 56. An advantage of having lugs 58 on the counterweight 26 is that counterweights 26 of different sizes and weights can be utilized interchangeably in the receiving aperture 44 for applications requiring different sized counterweights. Another advantage of having lugs 58 on counterweight 26 and lugs 48, 50 on enclosures 22 and 24, respectively, is that the counterweight 26 and/or the enclosure assembly can be removed from the excavator 2 to reduce the weight of the excavator 2 during transportation between excavation sites. This is particularly advantageous in that the counterweight 26 and/or the enclosure assembly can be shipped separately from the excavator 2 thereby reducing the required load capacity of a vehicle transporting the excavator by the weight of the counterweight 26 and/or the enclosure assembly.

A front panel 62 is secured between side walls 34, 38 and in spaced relation to back panel 42 by the bottom panel 40. The front panel 62 further defines the receiving aperture 44 and provides an aesthetically appealing surface covering the counterweight 26. Front panel 62 also aids in maintaining the counterweight 26 in position in receiving aperture 44 when the excavator 2, and specifically the upper section 4 of the excavator 2, is in motion. Specifically, front panel 62, back panel 42 and side walls 34, 38 are secured together to form the receiving aperture 44 and will restrain counterweight 26 from moving laterally. The bottom panel 40 secured to the frame 56, in a manner to be hereinafter described, restrains the counterweight 26 from downward movement while the weight of the counterweight 26 is sufficient to avoid most upward movement of the counterweight 26. It is preferable, however, to prevent lateral shifting of the counterweight 26 in the receiving aperture 44. Hence, the bottom panel 40 includes one or more upwardly extending bosses 64 and the counterweight 26 includes one or more cavities 66 extending into a bottom surface thereof for complementary engagement with the bosses 64 on bottom panel 40. The bosses 64 coact with the cavities 66 to positively locate the counterweight 26 and help minimize or prevent lateral shifting of the counterweight 26 in the receiving aperture 44.

To avoid movement of the counterweight 26 in the receiving aperture 44, one or more bolts 68 are projected downwardly through bores 70 formed in the counterweight 26 that extend between the top surface and the bottom surface of the counterweight 26. The ends of the bolts 68 protruding through the bottom surface of the counterweight 26 are projected through holes 72 formed in the bottom panel 40 and in alignment with bores 70. The ends of the bolts 68 extending through the holes 72 in the bottom panel 40 have threads thereon for threaded engagement with mating threads of nuts 74 secured to the underside of bottom panel 40. Utilizing bolts 68 and nuts 74, the counterweight 26 can be firmly secured to the bottom panel 40 and against movement during operation of the excavator 2.

The bottom panel 40 is secured to the frame 56 by a plurality of bolts 76 projected upwardly through holes 78 formed in mounting blocks 80 attached to frame 56. As shown in FIG. 3, each enclosure 22 and 24 extends below the bottom panel 40 which will serve to center the counterbalance assembly 20 on the frame 56 during installation. The ends of the bolts 76 projecting upwardly through holes 78 extend through holes 82, shown best in FIG. 4, formed in bottom panel 40 and in alignment with holes 78. The ends of the bolts 76 projecting upwardly through holes 82 in bottom panel 40 have threads thereon for threaded engagement with mating threads of nuts 84 secured to the topside of bottom panel 40. The cavities 66 on the bottom of counterweight 26 are of sufficient extent to encompass nuts 84 when the counterweight 26 is positioned on the bottom panel 40. In this manner, the bottom of counterweight 26 does not rest on nuts 84 when the counterweight is secured to the bottom panel 40.

The enclosures 22, 24 include access doors 86 and 88, respectively, which are positioned adjacent the front panel 62. When access doors 86 and 88 are in a closed position against front panel frames 87 and 89, the access doors 86 and 88 are disposed opposite back walls 32, 36. The access doors 86, 88 include a plurality of hinge assemblies 90 that are preferably positioned adjacent front panel 62 and side walls 34 and 38. The hinge assemblies 90 define axes 92, 94 about which access doors 86 and 88, respectively, pivot thereby providing for the selective access/sealing of the insides of enclosures 22, 24 from the outside thereof. When closed, each access door 86 and 88, together with the associated front panel frames 87 and 89, form a front for each enclosure 22 and 24.

As shown in FIG. 2, the counterbalance assembly 20 of the present invention is taller than the counterbalance 14 of the prior art shown in FIG. 1. If it is desired to utilize the counterbalance assembly 20 of the present invention with an excavator 2 having an engine cover 16 with engine cover vents 18 therein, a path for air to flow to the engine cover vents 18 may be provided through the counterbalance assembly 20 of the present invention. Hence, the back walls 32, 36 of the first and second enclosures 22, 24, respectively, include vents 96 therein and the access doors 86, 88 of the first and second enclosures 22, 24, respectively, include vents 98 therein. The vents 96 in the back walls 32, 36 are formed to be generally in alignment with the engine cover vents 18 when the enclosures 22, 24 are positioned on frame 56. In contrast, the vents 98 in the access doors 86, 88 can be placed therein in any convenient or desired location. Alternatively, vents 98 can be located on any of the walls of the enclosures 22, 24 in a manner that provides for air to flow between vents 98 and 96.

As can be seen from the foregoing, the present invention provides a counterbalance assembly 20 of approximately the same size and weight as the prior art counterweight 14 while providing additional space that can be utilized for, without limitation, storage of equipment and/or the locating of generators, pumps and the like for access and connection to the power/hydraulic systems of the excavator 2 to be powered thereby. Moreover, the counterweight of the present invention is easily removable from the counterbalance assembly. This ease of removal enables the use of counterweights having different weights, wherein the different weights are used for different applications. Moreover, the ease of removal enables transportation of the counterweight separate from the excavator. This reduces the required load capacity of a vehicle transporting the excavator.

The invention has been described with reference to the preferred embodiments. Obvious modifications and alterations will occur to others upon reading and understanding the preceding detailed description. For example, the counterbalance assembly can be used with construction equipment, other than an excavator, to offset activities of such construction equipment. Moreover, the counterweight assembly can alternatively have a central enclosure with a counterweight on either side of the enclosure or alternating enclosures and counterweights. It is intended that the invention be construed as including all such modifications and alterations insofar as they come within the scope of the appended claims or the equivalents thereof.

I claim:

1. A removable counterbalance assembly for use in construction equipment, the counterbalance assembly comprising:

a bottom panel attachable adjacent an aft end of the construction equipment;

an enclosure including a side wall having a lower portion positionable in fixed relation to the bottom panel, the bottom panel and the side wall defining a receiving aperture; and a counterweight adapted to be received in the receiving aperture.

2. A removable counterbalance assembly for use on an aft end of an excavator having a pivotable arm positioned adjacent the front end thereof, the counterbalance assembly comprising:

two enclosures, each enclosure having a back wall connected to a side wall, the enclosures positioned so that the side walls are in opposition;

a back panel connected between the back walls of the enclosures;

a bottom panel connected to the back panel and between the side walls of the enclosures;

a receiving aperture defined by the side walls, the back panel and the bottom panel; and a counterweight receivable in the receiving aperture.

3. A counterbalance assembly for use on an aft end of an excavator having a pivotable arm positioned adjacent the front end thereof, the counterbalance assembly comprising:

two enclosures, each enclosure having a back wall connected to a side wall, the enclosures positioned so that the side walls are in opposition;

a back panel connected between the back walls of the enclosures;

a bottom panel connected to the back panel and between the side walls of the enclosures;

a receiving aperture defined by the side walls, the back panel and the bottom panel; and a counterweight receivable in the receiving aperture, wherein:

at least one of the enclosures further includes a cover that abuts the back wall and the side wall;

the side wall includes a lug that extends upwardly from the intersection of the side wall and the cover; and the lug has a hole therethrough.

4. The counterbalance assembly as set forth in claim 3 wherein the counterweight further includes a lug positioned on the counterweight, wherein the lug extends upwardly adjacent the upwardly extending lug of the side wall when the counterweight is received in the receiving aperture, and wherein the lug has a hole therethrough.

5. The counterbalance assembly as set forth in claim 2 further including a front panel positioned in opposition to the back panel and extending between the side walls, wherein the receiving aperture is further defined by the front panel.

6. The counterbalance assembly as set forth in claim 5 wherein at least one of the enclosures further includes an access door positioned opposite the back wall.

7. The counterbalance assembly as set forth in claim 6 wherein each access door is pivotally hinged along a vertical axis.

8. The counterbalance assembly as set forth in claim 7 wherein the vertical axis is adjacent the side wall and the front panel.

9. A counterbalance assembly for use on an aft end of an excavator having a pivotable arm positioned adjacent the front end thereof, the counterbalance assembly comprising:

two enclosures, each enclosure having a back wall connected to a side wall, the enclosures positioned so that the side walls are in opposition;

a back panel connected between the back walls of the enclosures;

a bottom panel connected to the back panel and between the side walls of the enclosures;

a receiving aperture defined by the side walls, the back panel and the bottom panel;

a counterweight receivable in the receiving aperture; and a front panel positioned in opposition to the back panel and extending between the side walls, wherein:

the receiving aperture is further defined by the front panel;

at least one of the enclosures further includes an access door positioned opposite the back wall; and the back wall includes a vent for enabling air to flow through at least one of the enclosures.

10. The counterbalance assembly as set forth in claim 2 wherein the back walls and the back panel are coplanar.

11. Construction equipment having:

a base;

an upper section rotatably mounted on said base rotatable about a rotation axis extending through the base and the upper section;

an arm pivotally attached adjacent a fore end of the upper section;

an engine compartment positioned on the upper section; and a counterbalance assembly removably attached adjacent the aft end of the upper section, the counterbalance assembly including:

a bottom panel attached to the upper section;

a back panel attached to the bottom panel adjacent the engine compartment;

at least one enclosure having a side wall attached to the bottom panel and the back panel; and at least one counterweight positioned in a receiving aperture formed by the back panel, the bottom panel and the side wall of the at least one enclosure.

12. The construction equipment as set forth in claim 11 wherein a pair of the enclosures is provided and wherein the receiving aperture is further defined by the side wall of the second enclosure positioned in opposition to the side wall of the first enclosure.

13. The construction equipment as set forth in claim 12 wherein one counterweight is positioned between the first enclosure and the second enclosure.

14. The construction equipment as set forth in claim 11 further including a securing means for securing the counterweight and the bottom panel to a frame of the construction equipment.

15. The construction equipment as set forth in claim 11 wherein the bottom panel has an upwardly extending boss and a bottom side of the counterweight has a cavity, wherein the cavity is positioned for complementary engagement with the boss when the counterweight is positioned in the receiving aperture.

16. The construction equipment as set forth in claim 13 further including a front panel extending between the side wall of the first enclosure and the side wall of the second enclosure and in opposition to the back panel, wherein the receiving aperture is further defined by the front panel.

17. The construction equipment as set forth in claim 11 wherein the at least one enclosure includes an access door positionable adjacent an edge of the side wall opposite the back panel.

18. The construction equipment as set forth in claim 17 wherein the access door is vertically hinged.

19. Construction equipment having:

a base;

an upper section rotatably mounted on said base rotatable about a rotation axis extending through the base and the upper section;

an arm pivotally attached adjacent a fore end of the upper section;

an engine compartment positioned on the upper section; and a counterbalance assembly attached adjacent the aft end of the upper section, the counterbalance assembly including:

a bottom panel attached to the upper section;

a back panel attached to the bottom panel adjacent the engine compartment;

at least one enclosure having a side wall attached to the bottom panel and the back panel; and at least one counterweight positioned in a receiving aperture formed by the back panel, the bottom panel and the side wall of the at least one enclosure, wherein:

an engine cover of the engine compartment and the at least one enclosure have air vents, the air vent of the engine cover and the air vent of the at least one enclosure positioned generally in alignment.

20. A counterbalance assembly for use on an aft end of an excavator having a pivotable arm positioned adjacent the front end thereof, the counterbalance assembly comprising:

two enclosures, each enclosure having a back wall connected to a side wall, the enclosures positioned so that the side walls are in opposition;

a back panel connected between the back walls of the enclosures;

a bottom panel connected to the back panel and between the side walls of the enclosures;

a receiving aperture defined by the side walls, the back panel and the bottom panel; and a counterweight receivable in the receiving aperture, wherein:

the back walls and the back panel are coplanar; and each enclosure extends below a bottom surface of the bottom panel.

* * * * *